United States Patent [19]

Gurries

[11] Patent Number: 4,515,408

[45] Date of Patent: May 7, 1985

[54] COUNTERWEIGHT SUPPORT FOR RESONANTLY DRIVEN TOOL

[75] Inventor: Raymond A. Gurries, Reno, Nev.

[73] Assignee: Resonant Technology Company, Sparks, Nev.

[21] Appl. No.: 484,395

[22] Filed: Apr. 13, 1983

Related U.S. Application Data

[63] Continuation-in-part of Ser. No. 329,149, Dec. 10, 1981, Pat. No. 4,402,629, which is a continuation-in-part of Ser. No. 157,138, Jun. 5, 1980, Pat. No. 4,340,255.

[51] Int. Cl.[3] ..... E01C 23/12

[52] U.S. Cl. ..... 299/37; 173/49; 173/162 R; 404/90; 299/14

[58] Field of Search ..... 299/37, 14; 404/133, 404/90; 173/139, 49, 162 R; 172/40; 37/DIG. 18

[56] References Cited

U.S. PATENT DOCUMENTS

| | | | |
|---|---|---|---|
| 3,150,724 | 9/1964 | Oelkers | 173/49 |
| 3,336,082 | 8/1967 | Bodine, Jr. | 299/37 |
| 3,828,864 | 8/1974 | Haverkamp et al. | 173/49 |
| 3,907,450 | 9/1975 | Cutler | 404/90 |
| 4,340,255 | 7/1982 | Gurries | 299/37 |
| 4,374,602 | 2/1983 | Gurries et al. | 299/37 |
| 4,402,629 | 9/1983 | Gurries | 299/37 |

*Primary Examiner*—Stephen J. Novosad
*Assistant Examiner*—Mark J. DelSignore
*Attorney, Agent, or Firm*—Townsend and Townsend

[57] ABSTRACT

The present invention provides an improved mechanism for positioning the weight relative to the resonant beam in resonantly driven impact systems.

17 Claims, 7 Drawing Figures

COUNTERWEIGHT SUPPORT FOR RESONANTLY DRIVEN TOOL

This application is a continuation in part of U.S. patent application Ser. No. 329,149, filed Dec. 10, 1981, now U.S. Pat. No. 4,402,629 entitled RESONANTLY DRIVEN PAVEMENT BREAKER; which is a continuation-in-part of U.S. patent application Ser. No. 157,138, filed June 5, 1980, entitled RESONANTLY DRIVEN VERTICAL IMPACT SYSTEM, now U.S. Pat. No. 4,340,255.

BACKGROUND OF THE INVENTION

The present invention relates to a counterweight support for a resonantly driven tool such as a pavement breaker.

U.S. Pat. No. 4,340,255 describes a vertical impact system used to break the pavement or tamp down the ground underlying a mobile vehicle. The vehicle includes a resonant beam supported at its nodes and excited at one end near its resonant frequency. A tool projects downwardly from the output end of the beam to break the pavement or tamp down the ground. A large weight is superimposed over the forward node of the beam to counteract the reaction forces of the tool striking the underlying surface. The weight is suspended from the vehicle so that the reaction forces are not transmitted by the weight to the vehicle, isolating the vehicle itself from the reaction forces.

The impact system design of U.S. Pat. No. 4,340,255, has been found to be quite useful, but there have been various problems in implementing the design concept. Specifically, gross movement of the weight relative to the forward node must be prevented, because such movement results in the weight bearing down on the beam at some distance from its actual node. The beam is essentially stationary at its node, but vibrating everywhere but the node, and even a small movement of the weight relative to the node position greatly increases the vibratory forces imparted to the vehicle. However, slight movement must be allowed between the beam and the weight because some small vibration of the beam relative to the weight is inevitable, even if all attempts are made to support the beam exactly at the node position.

Relatively large reaction forces are imparted to the weight by the tool through the beam. The support system must prevent gross movement of the weight relative to the beam, while permitting slight movement, and still accomplish the transmission of the relatively large forces. The pad assembly connecting the weight to the beam, and the pivotal support of the weight at a position above the resonant beam, as described in the referenced patent, have been found less effective than desired in accomplishing these objectives.

SUMMARY OF THE INVENTION

The present invention provides an improved mechanism for positioning the weight relative to the resonant beam in resonantly driven impact systems of the type described in U.S. Pat. No. 4,340,255. The weight is linked to the resonant beam at the node proximate the output end of the beam. A member is fastened to the weight and extends to a position adjacent the node of the beam proximate the input end of the beam. The member is pivotally mounted to the frame at the node proximate the input end of the beam so that the member and attached weight are rotatable about the same axis as the resonant beam. As a result, the weight does not move relative to the node proximate the output end of the beam as the beam itself pivots about its aft node support.

The present invention further provides a recess in the lower portion of the weight, and a plate is located within the recess. Resilient, deformable material is provided intermediate the plate and the walls of the recess to prevent direct contact between the plate and the recess. Preferably, a slight gap is allowed between the deformable material and the plate to allow slight relative movement. The plate is linked to the resonant beam at the node proximate its input end.

Pivoting both the weight and the resonant beam about the same axis, namely, the support axis for the aft node of the resonant beam, prevents gross movement of the weight relative to the beam. Providing a recess in the lower end of the weight, and a plate in the recess but isolated from the walls thereof by deformable material, provides a large bearing surface for the weight so that the weight can absorb large reaction forces transmitted by the tool through the beam. The resiliency of the deformable material, and preferably a slight gap provided as well, allow for slight vibratory movement of the beam relative to the weight. The present invention thus provides a substantial improvement in the design shown in the referenced patent by accommodating large reaction forces while preventing gross movement of the weight relative to the beam but allowing slight movement therebetween.

The novel features which are characteristic of the invention, as to organization and method of operation, together with further objects and advantages thereof will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

DESCRIPTION OF THE PREFERRED EMBODIMENT

Figure 1:
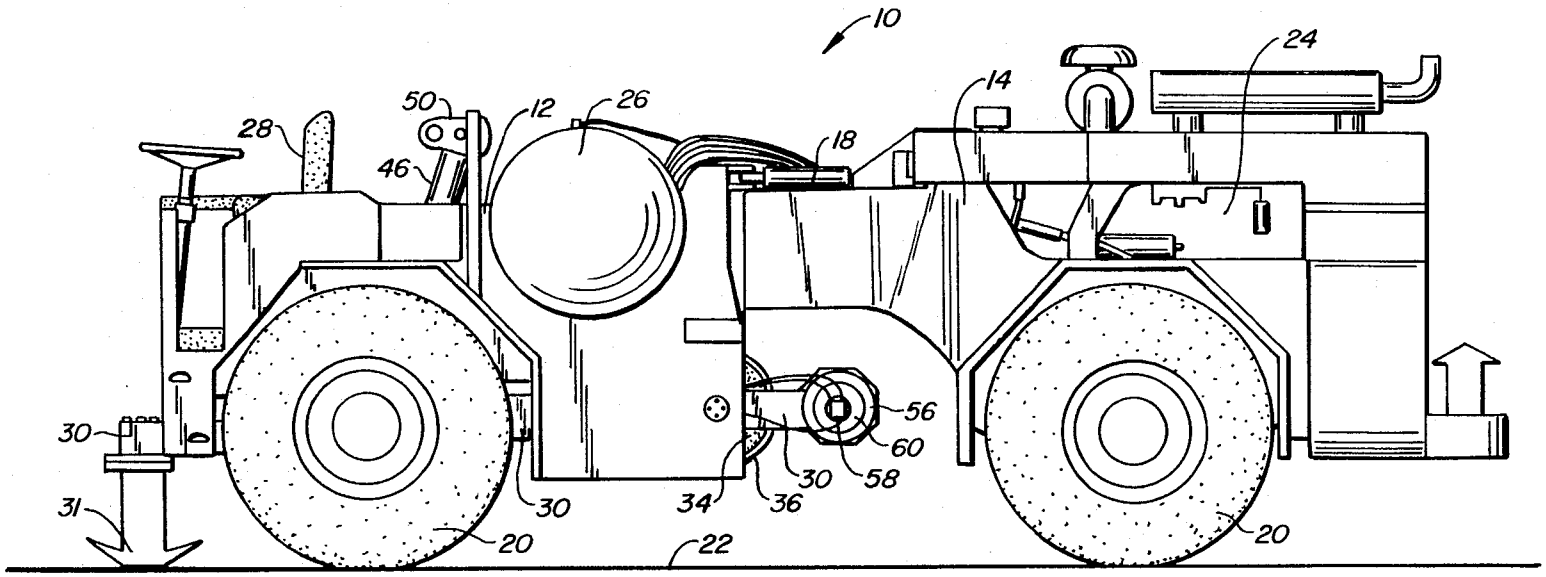
FIG. 1 is an elevation view of a preferred embodiment of a vertical impact system incorporating the present invention.
Figure 2:
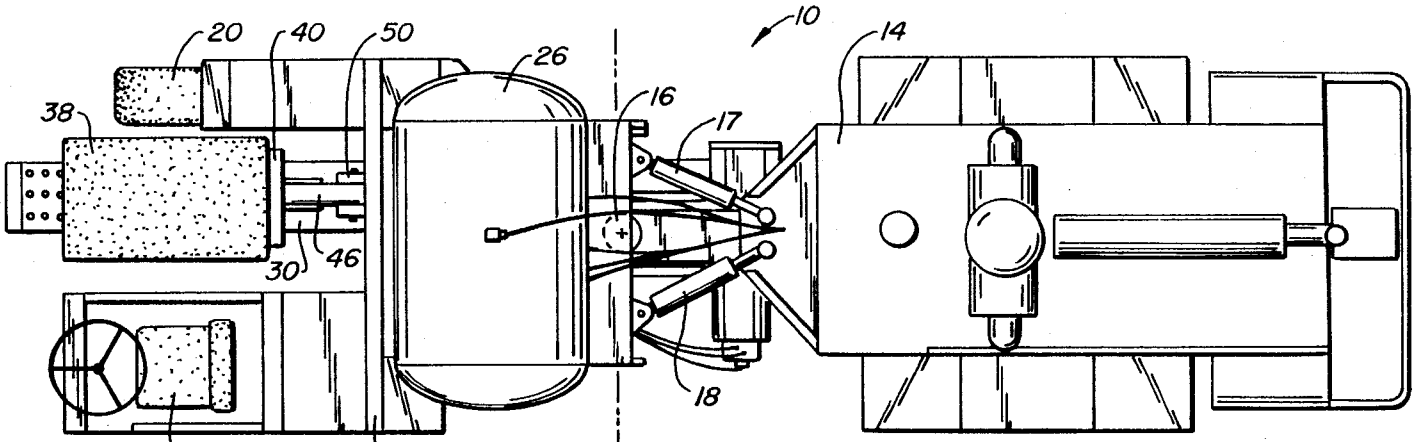
FIG. 2 is a plan view of the embodiment of FIG. 1.

The preferred embodiment 10 of a vertical impact system incorporating the present invention is illustrated generally by way of reference to FIGS. 1 and 2 in combination. Impact system 10 includes a carrier vehicle with a forward frame 12 connected to a rear frame 14 by an articulating joint 16. Hydraulic actuators 17, 18 extend between forward and rear frames 12, 14 to control articulation of the vehicle. The carrier vehicle rides on wheels 20 over a surface 22 which is to receive vertical impact forces for some purpose, such as old pavement to be broken up and removed, a roadbed to be tamped down, and the like.

An engine 24 is mounted on rear frame 14, and provides both motion power for the wheels 20 and hydraulic power from a reservoir 26. The operator of the vehicle rides in a control cab 28 projecting forwardly and to one side of the remainder of the vehicle.

Figure 4:
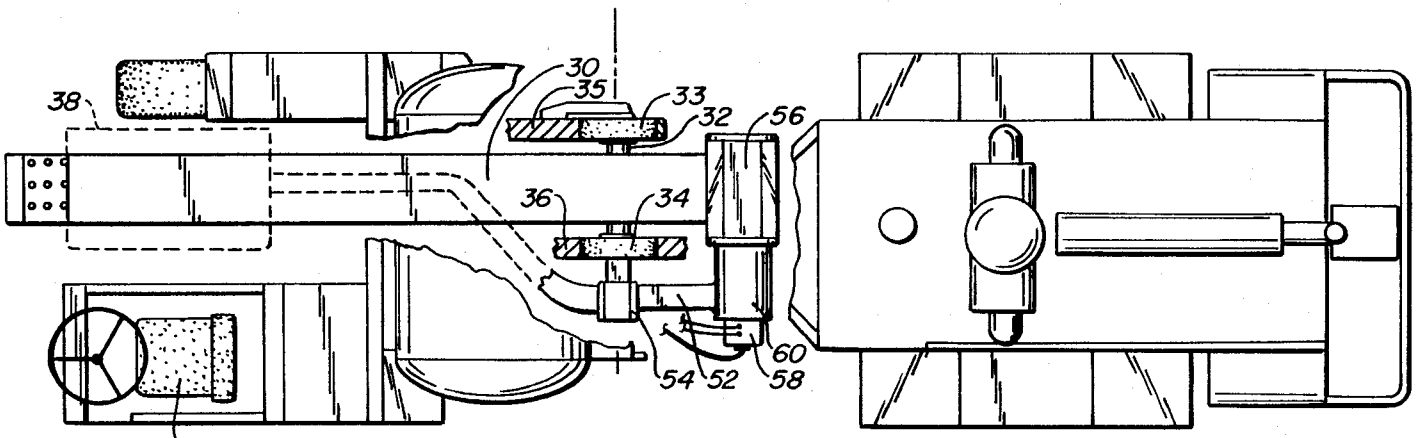
FIG. 4 is a plan view of the embodiment of FIG. 1 with portions broken away.
Figure 3:
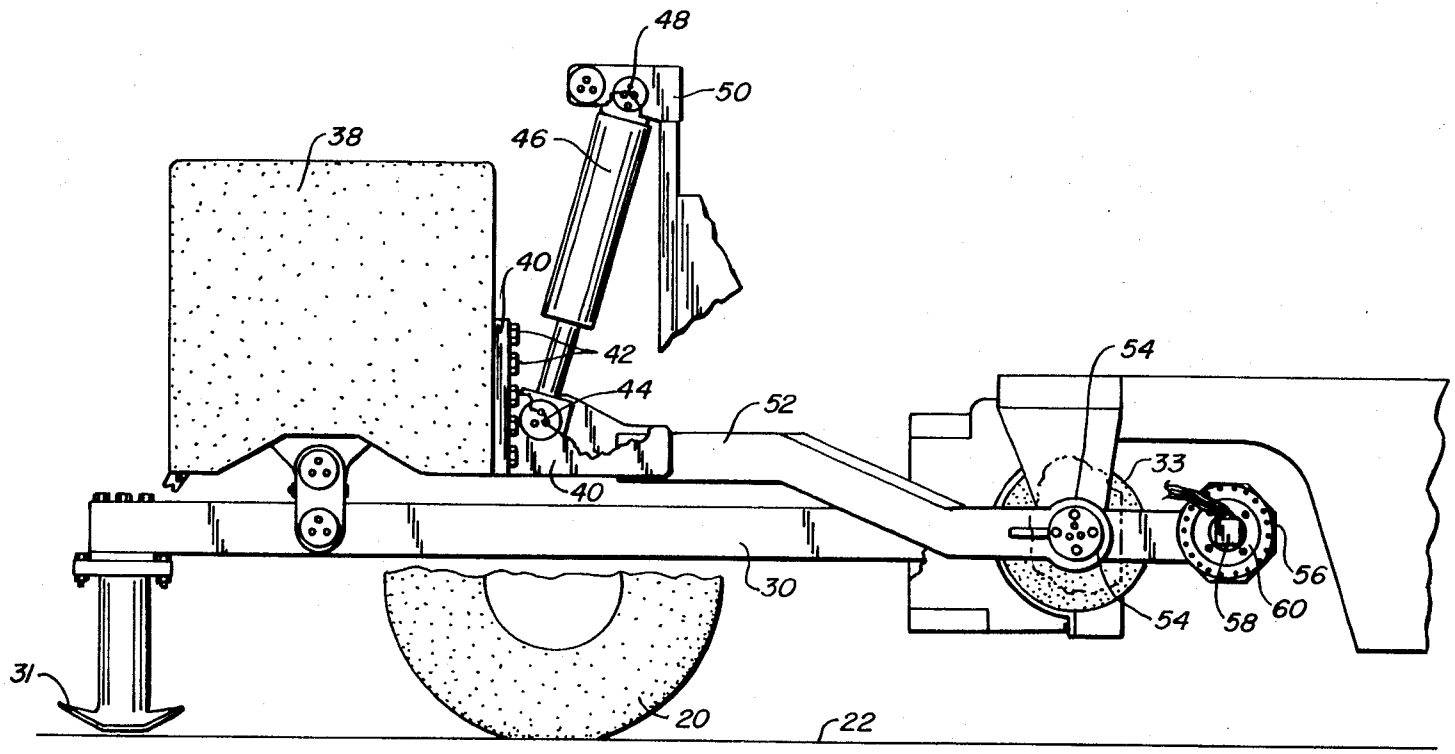
FIG. 3 is a fragmentary elevation view of the forward section of the embodiment of FIG. 1 with portion broken away.

A solid, homogeneous resonant beam 30, typically steel, is supported by the carrier vehicle, as depicted in more detail by way of reference to FIGS. 3 and 4. In the preferred embodiment, resonant beam 30 is approximately 12½ feet long, and has a resonant frequency of about 45 cycles per second when vibrating transversely about forward and aft nodes spaced inwardly from its ends. While resonating in this fashion, resonant beam 30 has antinodes (locations of maximum amplitude) at its opposite ends and approximately at its center. A tool, such as the pavement cutting tool 31 illustrated, depends from the forward end of beam 30.

Resonant beam 30 is supported at its aft node by a shaft 32 which projects through the beam at the location of the aft node (see U.S. Pat. No. 4,320,807). Shaft 32 is supported by a pair of pneumatic tires 33, 34 embedded in frame members 35, 36 forming part of the forward frame 12 of the vehicle. Since shaft 32 passes through a node position of beam 30, vibration of the beam at the node position is relatively small (theoretically zero) and the transmission of vibratory forces from the beam to the frame is minimized. The beam is further isolated from the frame by the use of pneumatic tires 33, 34 for support.

A massive weight 38 is superimposed over beam 30 toward its forward end. A large bracket 40 is fixed to beam 38 by bolts 42. A hydraulic cylinder 46 depends from a pin 48 attached to a portion 50 of the forward frame 12, and is fixed to bracket 40 by pin 44. Hydraulic cylinder 46 is of the single acting type, in which the cylinder can be contracted to lift weight 38, but cannot be extended to push down on the weight. Use of such a single acting cylinder allows weight 38 to be raised for transportation of the system, but inhibits the transmission of reaction forces from weight 38 to frame element 50 of the vehicle.

Bracket 40 is welded to a support member 52 having a zigzag configuration, the aft portion of which runs parallel to resonant beam 30. A collar 54 is formed in support member 52, and circumscribes shaft 32 to which resonant beam 30 is fixed at its aft node. Collar 54 is rotatable relative to shaft 32, so that support member 52, with weight 38 attached, is rotatable about the same axis as resonant beam 30.

Resonant beam 30 includes an enlarged housing 56 at one end, in which an eccentric oscillator is mounted. An hydraulic motor 58, which drives the oscillator, is located within enlarged portion 60 at the aft end of support beam 52. Since support member 52 and resonant beam 30 rotate in unison about shaft 32, the location of hydraulic motor 58 is fixed relative to the oscillator within housing 56.

Figure 7:
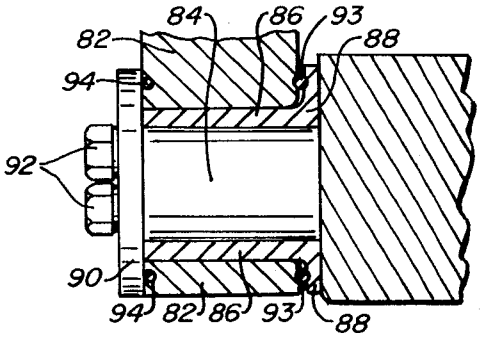
FIG. 7 is an enlarged fragmentary view taken along lines 7—7 of FIG. 6.
Figure 5:
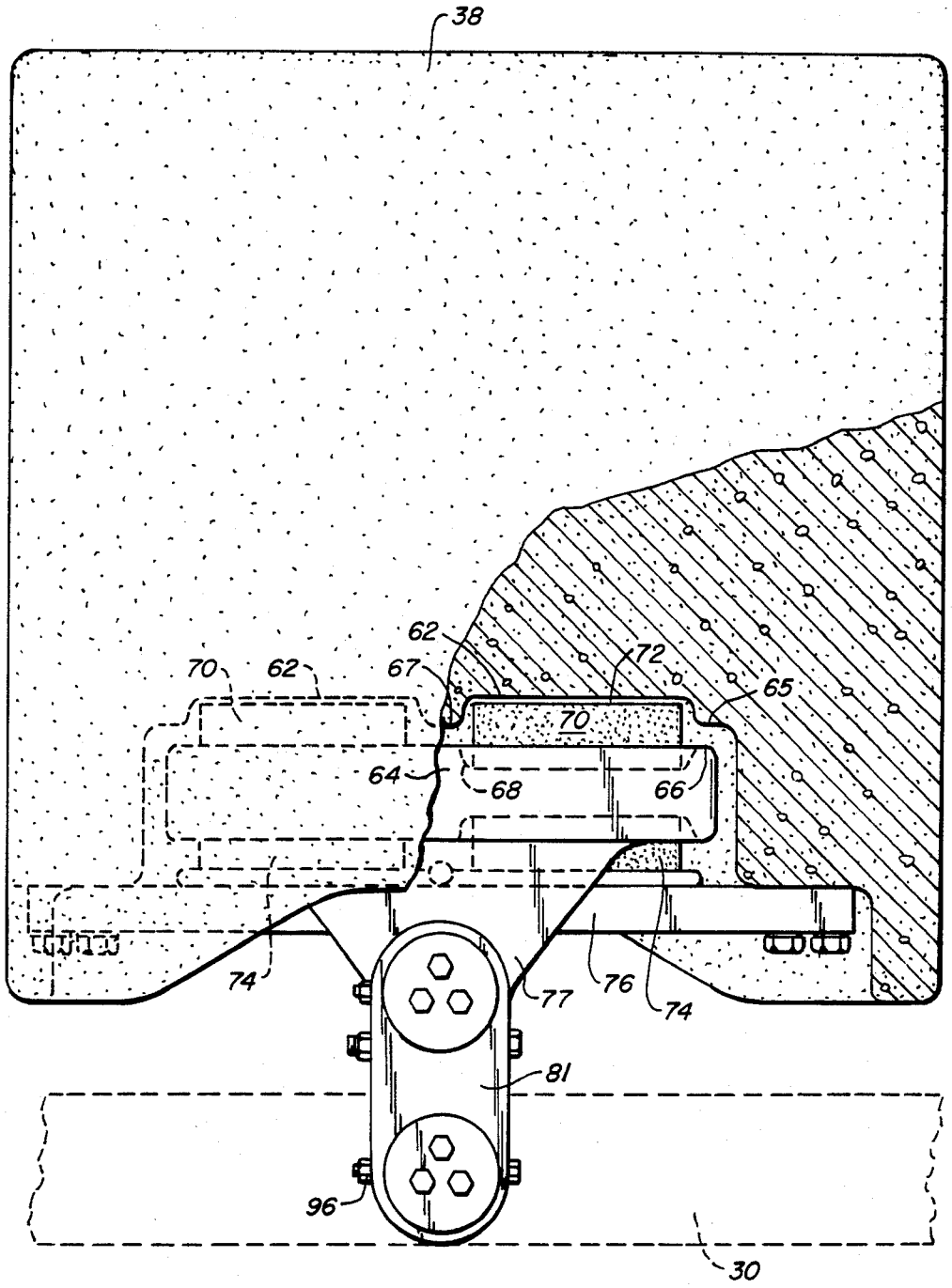
FIG. 5 is a fragmentary elevation view showing the attachment of the weights of the beam in the embodiment of FIG. 1.
Figure 6:
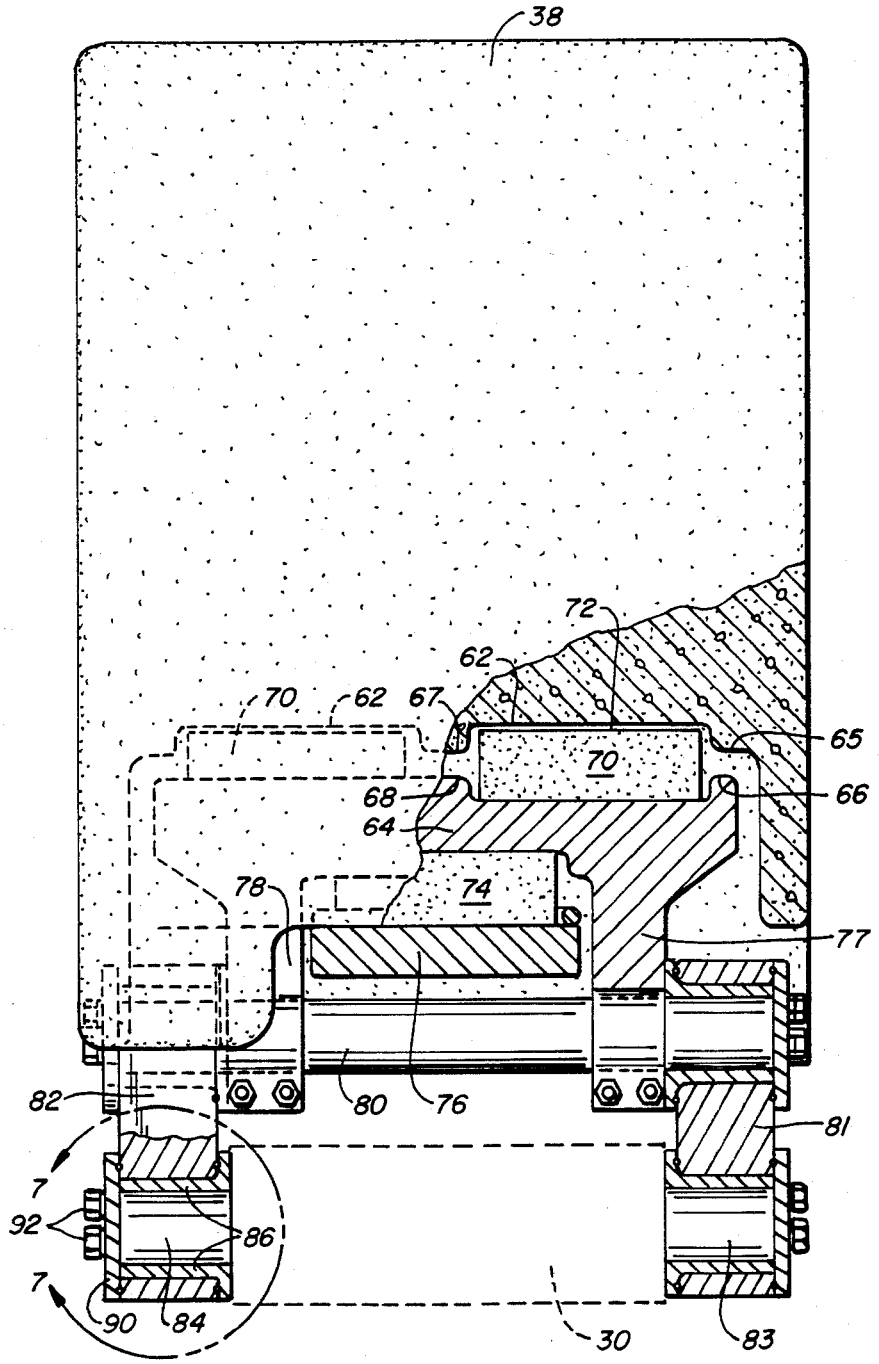
FIG. 6 is a front elevation similar to that of FIG. 5.

The manner in which weight 38 is attached to resonant beam 30 is illustrated in FIGS. 5–7. A recess 62 is formed in the lower portion of weight 38, and a plate 64 is located in the recess. Both recess 62 and plate 64 have complementary ridges such as 65, 66 and 67, 68 which define a plurality of cavities overlying the plate. Pads 70 of resilient, deformable material are located within these cavities, leaving a slight vertical gap 72 on the order of 1/16 to ⅛ inch. Pads 70 essentially isolate weight 38 from the high frequency vibrations of resonant beam 30, yet provide a large surface area through which the downward force of weight 38 can be imposed on the resonant beam. Corresponding pads 74 are located beneath plate 64 overlying cross member 76 to vertically support the forward portion of resonant beam 30 when the resonant beam is not in operation, i.e., when the upward reaction forces from the tool do not force the resonant beam upwardly against the weight.

Plate 64 includes a pair of downwardly projecting stirrup members 77, 78 which attach to a transverse pin 80. Links 81, 82 are fixed to the respective ends of pin 80, as will be illustrated in more detail hereinafter, and connect pin 80 to abutments 83, 84 projecting transversely from resonant beam 30 at its forward node location.

The attachment of link 82 to abutment 84 is illustrated in detail in FIG. 7. A bushing 86 circumscribes abutment 84. Link 82 is confined between the flange portion 88 of bushing 86 and a cap 90, which is fixed to the end of abutment 84 by bolts 92. The width of link 82 is slightly less than the distance between flange portion 88 of bushing 86 and cap 90, preferably on the order of about 1/16 to ⅛ inch. O-ring seals 93, 94 define a cavity into which grease can be inserted through fitting 96 to minimize friction between link 82 and bushing 86. The attachment of link 82 to the end of pin 80 is similar, as is the attachment of link 81 to abutment 83 and pin 80.

In operation, when tool 31 is performing a breaking or tamping operation, reaction forces from the tool striking the underlying surface are transmitted through beam 30, through various links to plate 64. The deformability of resilient pads 70, together with a slight gap between the pads and plate 64, dampen high frequency vibrations but transmit the reaction forces to weight 38. The reaction forces are substantially absorbed by weight 38, and not transmitted to the vehicle as a whole.

As the underlying terrain varies, or as the depth of cut of the tool varies, resonant beam 30 will pivot about shaft 32 at its aft node support. Weight 38 is supported by support member 52 which also pivots about shaft 32, and thus the weight and resonant beam will pivot in unison. As a result weight 38 remains superimposed directly over the forward node, and the fixed node support described herein can be utilized.

When the impact system is not in the process of performing a breaking or tamping operation, weight 38, acting through various links, supports the forward end of resonant beam 30. Single acting cylinder 46 is contracted to hold the weight and the resonant beam in position so that the vehicle can be moved from place to place.

While a preferred embodiment of the present invention has been illustrated in detail, it is apparent that modifications and adaptations of that embodiment will occur to those skilled in the art. However, it is to be expressly understood that such modifications and adaptations are within the spirit and scope of the present invention, as set forth in the following claims.

I claim:

1. In a resonantly driven power tool including a frame, a resonant beam having a pair of nodes spaced inwardly from the ends of the beam and input and output antinodes at respective input and output ends of the beam, means for pivotably attaching the resonant beam to the frame at the node proximate the input end of the beam, a weight superimposed over the node proximate the output end of the beam, an oscillator at the input end of the beam for vibrating the beam at at least near its resonant frequency, and a working tool at the output end of the beam, improved means for positioning the weight relative to the resonant beam comprising means for linking the weight to the resonant beam at the node proximate its output end, a member fastened to the weight and extending to a position adjacent the node of the beam proximate its input end, and means for pivotably mounting the member to the frame at said node proximate the input end of the beam so that the member and attached weight are rotatable about the same axis as the resonant beam.

2. The power tool of claim 1 in which the weight has a recess proximate its lower end, and wherein the linking means comprises a plate located within the recess; resilient, deformable material intermediate the plate and the walls of the recess to prevent direct contact between the plate and the recess; and means for linking the plate to the resonant beam at the node proximate its output end.

3. The power tool of claim 2 in which the recess and the plate each include ridges engaging the deformable material to prevent transverse movement of the weight relative to the plate.

4. The power tool of claim 3 in which the deformable material comprises a plurality of deformable pads located above and below the plate.

5. The power tool of claim 1 in which the oscillator includes an eccentric weight embedded in the input end of the beam and a drive motor flexibly coupled to the eccentric weight, the member extends to a position proximate the input antinode of the resonant beam, and additionally comprising means for mounting the drive motor to the member so that the drive motor pivots along with the resonant beam.

6. The power tool of claim 1 in which the frame is a part of a mobile vehicle.

7. The power tool of claim 6 in which the working tool comprises a pavement breaking tool depending from the output end of the resonant beam.

8. In a resonantly driven power tool including a frame, a resonant beam having a pair of nodes and input and output antinodes at respective input and output ends of the beam, means for pivotably attaching the resonant beam to the frame at the node proximate the input end, a weight superimposed over the node proximate the output end of the beam, an oscillator at the input end of the beam for vibrating the beam at at least near its resonant frequency, and a working tool at the output end of the beam, improved means for fixing the weight to the resonant beam comprising a recess in the weight proximate the lower end of the beam; a plate located within the recess; resilient, deformable material intermediate the plate and the walls of the recess to prevent direct contact between the plate and the recess; and means for linking the plate to be resonant beam at the node proximate its output end.

9. The power tool of claim 8 wherein the recess and the plate each include a plurality of ridges, and wherein the deformable material comprises a plurality of deformable pads located above and below the plate and bounded by the ridges to prevent relative transverse movement.

10. The power tool of claim 4 or 9 in which a vertical gap between about 1/16 and ⅛ inch is provided between the plate and the pads to allow relative movement between them.

11. The power tool of claim 8 wherein the linking means comprises abutments emanating transversely from the resonant beam at the node proximate its output end, a pin disposed over the beam at the node proximate its output end, a pair of links joining the pin to the abutments; and stirrup members projecting from the plate and engaging the pin.

12. A pavement breaker comprising:

a mobile vehicle for riding on a surface;

a horizontal resonant beam having a pair of nodes and input and output antinodes at respective input and output ends of the beam;

means for pivotably attaching the resonant beam to the frame at the node proximate the input end of the beam;

a weight superimposed over the node proximate the output end of the beam;

a member fastened to the weight and extending to a position adjacent the input end of the beam;

means for pivotably mounting the member to the frame at the node proximate the input end of the beam;

an oscillator at the input end of the beam for vibrating the beam at at least near its resonant frequency, said oscillator including a drive motor mounted to the member so that the weight and the drive motor are rotatable about the same axis as the resonant beam;

a tool depending from the output end of the beam and adapted to strike the surface beneath the beam, the reaction force from the tool striking the surface being substantially absorbed by the weight and not transmitted to the frame.

13. The pavement breaker of claim 12 and additionally comprising means for linking the weight to the resonant beam at the node proximate its output end.

14. A resonantly driven power tool comprising:

a frame;

a horizontal resonant beam having a pair of nodes and input and output antinodes at respective input and output ends of the beam;

means for pivotably attaching the resonant beam to the frame at the node proximate the input end of the beam;

a weight superimposed over the node proximate the output end of the beam and having a recess proximate its lower end;

a plate located within the recess and including a stirrup member projecting downwardly to a position outside the recess;

resilient, deformable material intermediate the plate and the walls of the recess to prevent direct contact between the plate and the recess, said material providing a spacing between the material and the plate on the order of about 1/16 to ⅛ inch to allow limited relative movement therebetween;

means for linking the stirrup member to the resonant beam at the node proximate its output end;

an oscillator at the input end of the beam for vibrating the beam at at least near its resonant frequency; and a working tool at the output end of the beam.

15. The power tool of claim 14 and additionally comprising a member fastened to the weight and extending to a position adjacent the node of the beam proximate its input end, and means for pivotably mounting the member to the frame at said node so that the member and attached weight are rotatable about the same axis as the resonant beam.

16. The power tool of claim 14 wherein the linking means comprises a pin disposed over the beam at the node proximate its input end and supported by the stirrup members, abutments, emanating transversely from the resonant beam at the node proximate its output end, and a pair of links joining the pin to the abutments.

17. The power tool of claim 11 or 16 and additionally comprising a bushing circumscribing each abutment and defining a lateral space for connection of the link, and wherein the transverse dimension of the link is less than that of the defined space by about 1/16 to $\frac{1}{8}$ inch.

* * * * *